US005330321A

United States Patent [19]

Roberts et al.

[11] Patent Number: 5,330,321

[45] Date of Patent: Jul. 19, 1994

[54] ROTOR SHROUD ASSEMBLY

[75] Inventors: Michael C. Roberts; John F. Leonard, both of Bristol, England

[73] Assignee: Rolls Royce plc, London, England

[21] Appl. No.: 59,292

[22] Filed: May 11, 1993

[30] Foreign Application Priority Data

May 19, 1992 [GB] United Kingdom ..... 9210642.6

[51] Int. Cl.[5] ..... F01D 11/08

[52] U.S. Cl. ..... 415/136; 415/138; 415/177

[58] Field of Search ..... 415/134, 136, 138, 139, 415/173.1, 177

[56] References Cited

U.S. PATENT DOCUMENTS

| | | | |
|---|---|---|---|
| 3,807,891 | 4/1974 | McDow et al. | 415/134 |
| 4,251,185 | 2/1981 | Karstensen | 415/136 |
| 4,527,385 | 7/1985 | Jumelle et al. | 415/138 |
| 4,565,492 | 1/1986 | Bart et al. | 415/136 |
| 5,080,557 | 1/1992 | Berger . | |

FOREIGN PATENT DOCUMENTS

| | | | |
|---|---|---|---|
| 0832301 | 4/1960 | United Kingdom | 415/134 |
| 1484288 | 9/1977 | United Kingdom . | |
| 1484936 | 9/1977 | United Kingdom . | |
| 2087979A | 6/1982 | United Kingdom . | |
| 0132182A1 | 6/1984 | United Kingdom . | |
| 2206651A | 1/1989 | United Kingdom . | |
| 2236147A | 3/1991 | United Kingdom . | |
| 2244524A | 4/1991 | United Kingdom . | |

*Primary Examiner*—Edward K. Look
*Assistant Examiner*—Mark Sgantzos
*Attorney, Agent, or Firm*—Oliff & Berridge

[57] ABSTRACT

In a gas turbine engine tip clearance between rotor blades and an encircling shroud liner is controlled by moving the shroud liner radially to match the thermal and centrifugal growth of the rotor assembly. The shroud liner segments are suspended between two axially displaced control rings located in a passageway carrying air ducted from the compressor. One control ring responds very quickly to changes in gas temperature corresponding to centrifugal growth and blade thermal growth. The other ring responds very much more slowly and corresponds to the thermal growth of the disc. The shroud liner segments are suspended from the control rings to adopt a position that constitutes the average between the growth positions of the two control rings.

13 Claims, 2 Drawing Sheets

ROTOR SHROUD ASSEMBLY

BACKGROUND OF THE INVENTION

This invention relates to a rotor shroud assembly in a gas turbine engine. In particular, it concerns the control of the clearance between the tips of the rotor blades of a turbine rotor and the encircling shroud assembly.

The radial growth of a bladed turbine rotor disc at any point in an engine operating cycle is governed by three factors namely:

The thermal growth of the rotor disc, which is influenced by the temperature of the high pressure compressor delivery cooling air;

The thermal growth of the turbine blades, which is influenced by the temperature of the combustion gases; and The centrifugal growth of a complete bladed rotor disc.

As a result of engine accelerations, blade thermal growth and bladed rotor disc growth factors respond very quickly. The disc thermal growth factor responds more slowly because of the greater bulk of the disc relative to that of the rotor blades.

These various growth changes affect the clearance between the tips of the rotor blades and the shroud surrounding those blades, and it is important for the purpose of engine operating efficiency that this clearance be controlled at all stages of engine operation.

It is conventional practice to surround the bladed rotor disc with a segmented shroud liner ring having an internal diameter slightly larger than the outside diameter of the blades of the disc so that a small clearance exists between the liner ring and the blade tips. The shroud liner ring comprises a number of segments each of which may change its radial position relative to the adjacent segments. When the engine is running, the liner segment is subject to the same high temperature exhaust gases as pass over the turbine blades so, as the blades change their length, and thus the diameter of the rotor changes, the ring of liner segments also changes its diameter.

It is relatively easy to control the turbine shroud liner segments by means of a control ring so that the shroud liner segments closely follow rotor disc growth at engine steady state conditions. As the major part of the bladed rotor growth is attributed to disc thermal expansion, the control ring is required to have a similarly slow response. However, having matched the control ring with the bladed rotor, problems arise when rapid acceleration and deceleration take place. To follow, as closely as possible, bladed rotor tip movement, the control ring growth must be boosted at the early stages of the acceleration cycle and attenuated at the early stages of the deceleration cycle.

SUMMARY OF THE INVENTION

According to one aspect of the invention, there is provided a gas turbine engine rotor seal for surrounding a rotor assembly of circumferentially spaced blades, each having a radial tip, comprising:

a plurality of arcuate shroud liner segments encircling the rotor assembly, each segment being mounted for radial movement and has a radially inner surface spaced from the tips of the blades by a predetermined clearance, a first control ring having a relatively rapid radial response to thermal change, a second control ring having a relatively slow radial response to thermal change, a mounting device coupled with the first and second control rings and supporting each of the shroud segments such that the radial position of each segment is continuously controlled by the thermal expansion of the first and second control rings in combination.

In a preferred arrangement, the coupling device comprises a rod extending through spherical bearings carried in the first and second control rings, and the mounting device comprises a spherical bearing in the shroud liner the spherical bearing supporting the rod between the spherical bearings in the first and second control rings.

BRIEF DESCRIPTION OF THE DRAWINGS

The invention will now be described, by way of example, with reference to the accompanying drawings in which.

DETAILED DESCRIPTION OF PREFERRED EMBODIMENTS

Figure 1:
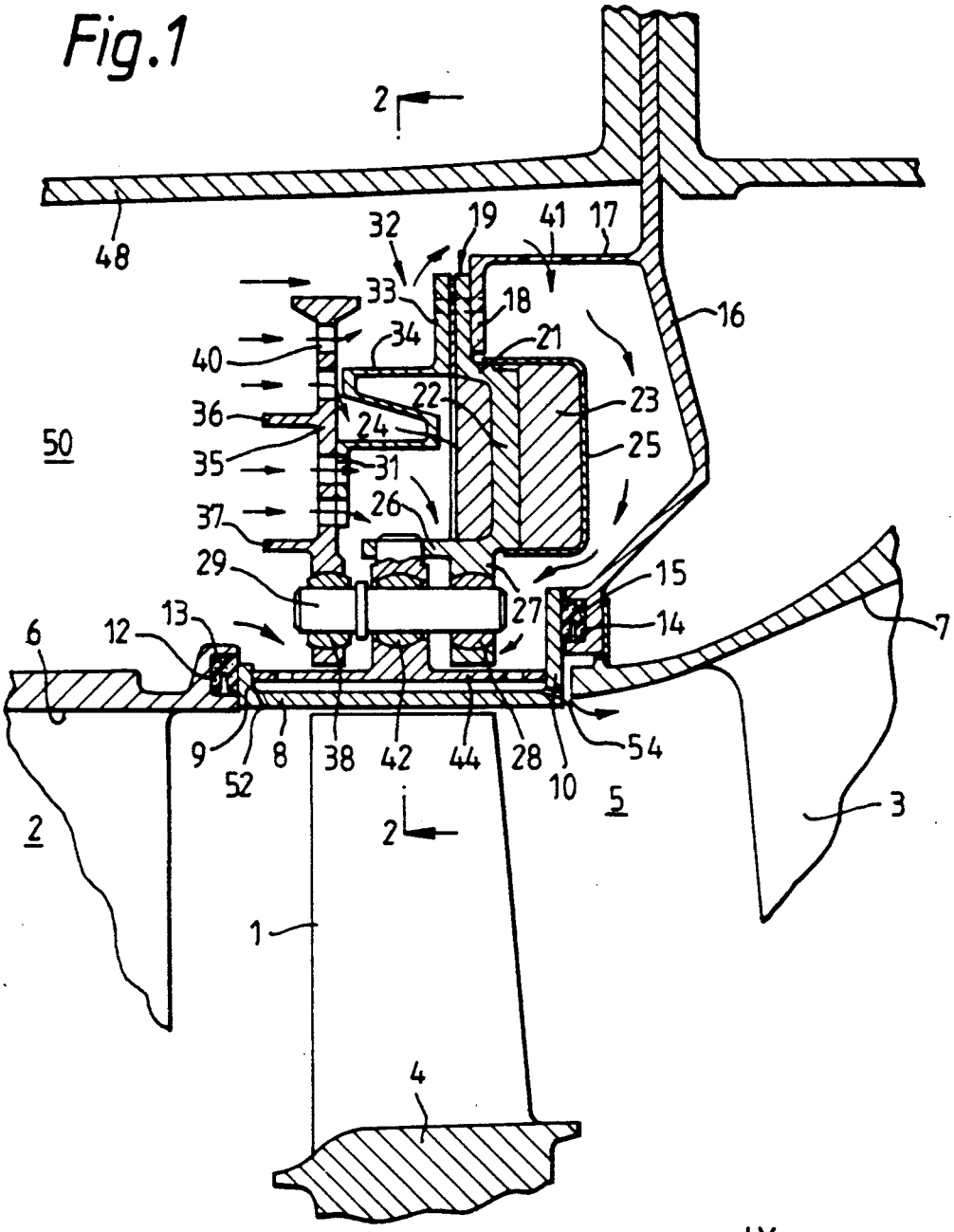
FIG. 1 shows a sectional side view of a control ring arrangement used in co-operation with a turbine bladed rotor disc.

Referring to FIG. 1, a turbine rotor blade 1 is shown located between a pair of guide vanes 2,3 and is secured to a central mounting disc 4 in a known manner, not shown. The blade 1 is one of an array of blades mounted for rotation within a duct 5 that comprises a forward cylindrical part 6 and a rearward diffuser duct member 7. The part 6 and member 7 are spaced apart to receive a shroud liner segment 8 having forward and rearward outwardly extending flanges 9,10 respectively. Flange 9 is engaged by a sealing ring 12 positioned within a recess 13 in the rear end of cylindrical part 6, whilst flange 10, which is longer than flange 9, engages a sealing ring 14 positioned within a recess 15 in a diaphragm 16 at the forward end of the diffuser duct 7.

A locating ring 17 extends forwardly from the diaphragm 16 and carries an annular flange 18 at its forward end to which a control ring member 19 is secured. Control ring member 19 includes a radially outer mounting ring 21, a central web portion 22 to which is secured a mass of thermal insulation material 23 enclosed within shield members 24,25, a forwardly directed flange 26 and an inwardly directed flange 27. The ring member 19 is heavily insulated such that it has a response rate to temperature change matched to that of the rotor disc. The radially inner flange 27, at a plurality of locations spaced apart circumferentially, is adapted to carry a suspension member 29. There are as many locations and members 29 as there are liner segments 8, and each member 29 supports a liner segment 8. In the illustrated example the member 29 consists of an actuation rod one end of which is located in the flange 27 of ring 19 by means of a spherical bearing.

A second control ring 35 is also secured to the annular flange 18 by means of a resilient, annular member 32.

This member 32 consists of inner and outer mounting rings 31,33 and an interconnecting annular web 34 of zig-zag radial section. The outer ring 33 is secured to the annular flange 18, together with the outer mounting ring 21 of the first control ring 19. The zig-zag section web 34 depends from the ring 33 and suspends the inner mounting ring 31 which carries the second control ring 35.

The ring 35 is of lightweight construction, it is of relatively thin gauge, is uninsulated and is pierced by a multiplicity of apertures 40,41 through which air bled from the engine compressor may pass. It is normal to bleed this air from the high pressure (HP) compressor for internal cooling purposes. Thus, it serves a dual purpose in the invention: first to warm or cool, as appropriate, the tip clearance control rings and second to fulfil its conventional air cooling function.

The second control ring 35 is provided with annular stiffening flanges 36,37 spaced apart in a radial direction. Around its radially inner circumference it is adapted to carry the plurality of suspension members 29 at locations spaced apart circumferentially. As mentioned above, in connection with the first control ring 19, the member 29 consists of an actuation rod one end of which is located in the first ring flange 27 by a spherical bearing. The opposite end of rod 29 is also located by means of a second spherical bearing in the second control ring 35. Thus, the actuation rods 29 are mounted at opposite ends between two control rings 19,35, which expand and contract at different rates in response to changes in their thermal conditions.

Figure 2:
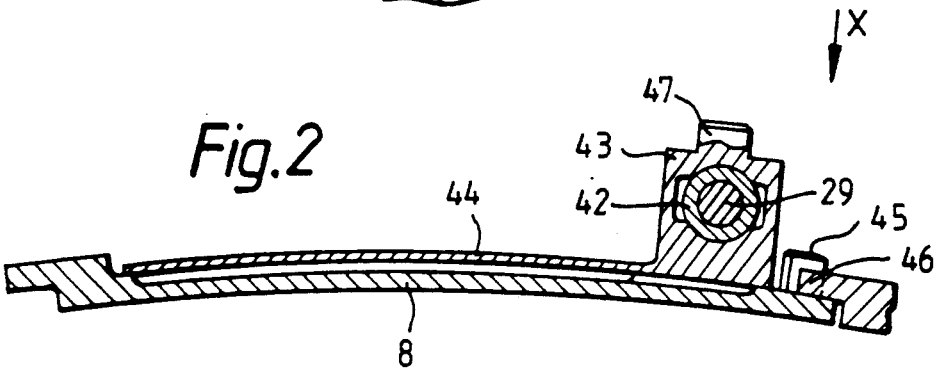
FIG. 2 shows a cross-section along the line 2—2 of the control ring arrangement shown in FIG. 1.
Figure 3:
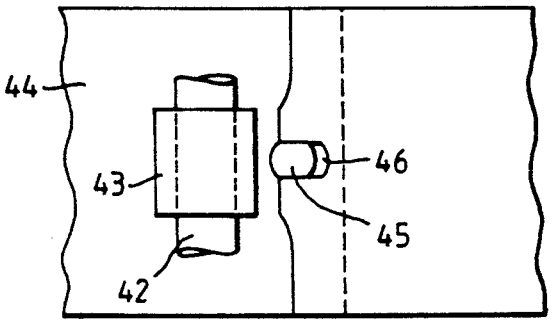
FIG. 3 is a view in the direction of arrow X in FIG. 2.

Each shroud liner segment 8, as can be seen in FIGS. 1 and 2, is supported by a backing plate 44 formed with an upstanding pillar 43 located in a circumferential direction towards one end of a segment and mid-way between its upstream and downstream. Backing plate 44 spans the distance between the flanges 9,10 of the shroud liner 8. Alternatively, the plate 44 may be omitted and the pillar formed integrally with a liner segment substrate. Each liner segment 8 is suspended from the actuation rod 29 by means of a spherical bearing 42 carried in pillar 43. A spigot 47 extends from the pillar 43 and is located in a recess in the flange 26 in order to control the pitch attitude of the shroud liner 8. The plate 44 may have recesses in its edges that abut flanges 9 and 10 to enable the passage of air between the radially outer and radially inner surfaces of the plate. As can be seen in FIG. 2, the shroud liner 8 comprises a number of segments pinned together by means of pin and slot connections 45,46 to allow for expansion and contraction of the annulus formed by the segments. The suspension bearing is located towards one end of a liner segment, in a circumferential direction. The opposite end of the segment backing member is stepped and overlapped with the adjacent edge of a neighboring segment for support. This end is this close to the suspension point of the neighboring segment.

The turbine section liner 6 together with engine casing 48 defines a passageway 50 which is blanked-off by diaphragm 16. HP compressor air is fed into the passageway at an upstream location, not shown in the drawings. A metered proportion of this air is allowed to escape as film cooling air through a multiplicity of cooling holes 52 circumferentially spaced apart around the upstream edge of the shroud annulus. Further film cooling air is permitted to escape in a controlled way through gaps 54 at the downstream edge of the shroud segments 8. Thereby a governed flow of compressor bleed air is established through the passageway 50 in which is housed the tip clearance control rings 19,35, controlling the radial position of the shroud liner segments 8. Since the pressure to which a gas is raised by a compressor is a function of engine speed, then the temperature of the gas is also a function of speed. Thus, the temperature of the gas flowing through the passageway 50 is dependent upon the operating speed of the engine.

The control ring arrangement used to control the blade tip clearance comprises two separate control rings 19 and 35. The ring 19 is heavily slugged with heat insulating material, is therefore slow to response and duplicates the thermal expansion of the turbine disc. The ring 35 in contrast is lightly constructed, is therefore quick to respond and duplicates the centrifugal expansion of the turbine disc and the thermal expansion of the turbine blades. The individual segments 8 forming the shroud liner ring are individually suspended by a member coupled to both control rings 19 and 35. In operation, therefore, the radial position of the liner segment 8 is determined by radial positions of the spherical bearings 42 on actuation rods 29. Because opposite ends of the rods 29 are carried by the fast and slow control rings 35,19 and the bearings 42 are mid-way between the rod ends their positions are always the average of the positions of the ends. The contributions of the two control rings are equally weighted. However, these weightings may be altered so that one or the other of the control rings exerts greater influence on the segment positions by displacing the suspension bearing 42 towards the corresponding control ring.

A still further arrangement may be envisaged wherein the actuation member 29 is cantilevered from the control rings and carries the segment suspending bearing 42 towards one end. The member 29 may be journalled at a mid-portion in the slow control ring 19 with the first control ring 35 disposed at the opposite end of the member. The ratio of the distances between the segment bearing 42 and the two control rings again determines their respective influences.

Figure 4:
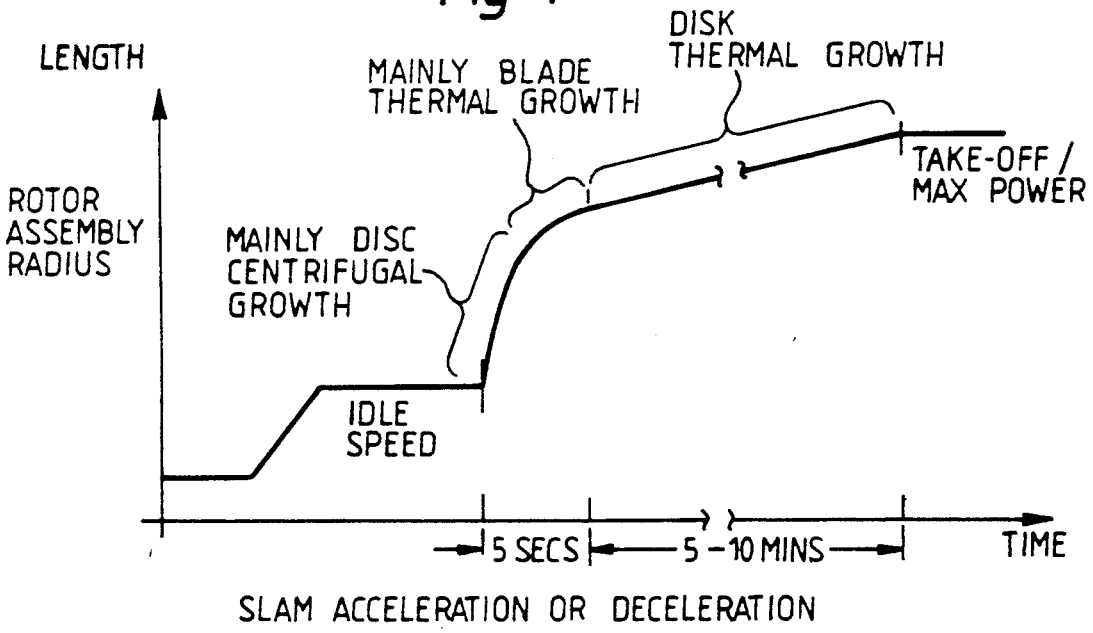
FIG. 4 illustrates thermal growth against time of the rotor disc.

The phases of rotor assembly expansion, and in reverse contraction, is illustrated in FIG. 4. When the engine is accelerated the turbine tips move rapidly outwards due to both the rapid thermal growth of the blades and the centrifugally generated growth of the turbine disc. This happens within a few seconds. Simultaneously the shroud liner 8 expands rapidly as the segments are pulled out by the thermal expansion of the control ring 35. Thereafter, the blade tips move slowly outward due to thermal expansion of the turbine disc while the shroud liner segments are slowly pulled out by the thermal expansion of the heavily insulated control ring 19. This happens much more slowly over a period of several minutes. The reverse happens when the engine is decelerated.

The arrangement described provides continuously variable control of the clearance between the turbine blade tips and the shroud liner to be maintained at a reduced level thereby providing an increase in engine efficiency. The manner in which each of the control rings contributes to the control of the tip clearance gap can be tailored to suit requirements. The thermal response of both control rings may be adapted as needed. The response of the slow response ring may be varied by altering the properties of the insulation and the thermal expansion properties of the material of the ring itself. Similarly the fast response ring may be altered by choice of material and design to follow the temperature of the HP air more, or less, closely. Also, as mentioned above, the degree to which each control ring influences the position of each shroud liner segment is determined by the spacing between the bearings carried by the control rings and the segment supports.

We claim:

1. A gas turbine engine rotor seal for surrounding a rotor assembly of circumferentially spaced blades, each having a radial tip, comprising:

a plurality of arcuate shroud liner segments encircling the rotor assembly, each segment being mounted for radial movement and having a radially inner surface spaced from the tips of said blades by a pre-determined clearance, a first control ring having a relatively rapid radial response to thermal change, a second control ring having a relatively slow radial response to thermal change, mounting means including a support member supporting each of the shroud segments, each support member being coupled to the first and second control rings and each of the shroud segments, whereby the radial position of the shroud segments is continuously controlled by the thermal expansion of the first and second control rings in combination.

2. A gas turbine engine rotor seal as claimed in claim 1, wherein each support member is coupled to the first control ring at a first location, to the second control ring at a second location, and to the shroud segments at a third location, whereby the radial position of the shroud segments is continuously controlled by the thermal expansion of the first and second control rings in proportion to the ratio of the distances between the first and third locations and the second and third locations.

3. A gas turbine engine rotor seal as claimed in claim 2 wherein the third location is intermediate the first and second locations.

4. A gas turbine engine rotor seal as claimed in claim 3 wherein the third location is mid-way between the first and second locations.

5. A gas turbine engine rotor seal as claimed in claim 2 wherein each mounting member comprises an elongate support rod.

6. A gas turbine engine rotor seal as claimed in claim 5 wherein each support rod has a first end which is coupled to the first control ring, a second end opposite the first end, which is coupled to the second control ring and a mid section intermediate the first and second ends which is coupled to a shroud segment.

7. A gas turbine engine rotor seal as claimed in claim 6 wherein each support rod is coupled to the first and second control rings and to a shroud segment through spherical bearings.

8. A gas turbine engine rotor seal as claimed in claim 1, wherein the first control ring is pierced by a plurality of apertures for the passage of compressor bleed air.

9. A gas turbine engine rotor seal as claimed in claim 1 wherein the second control ring is thermally insulated.

10. A gas turbine engine rotor seal as claimed in claim 1 wherein the shroud segments are disposed end-to-end to form an annulus.

11. A gas turbine engine rotor seal as claimed in claim 10 wherein each shroud segment has a first end which is supported by the mounting means through a coupling.

12. A gas turbine engine rotor seal as claimed in claim 11 wherein each shroud segment has a second end opposite the first end which for support is overlapped with the first end of an adjacent shroud segment.

13. A gas turbine engine rotor seal as claimed in claim 10 wherein adjacent ends of neighbouring shroud segments are axially located one relative to another by means of a peg formed towards one end of a shroud which is engaged by a slot formed towards the adjacent end of the neighbouring shroud.

* * * * *